US005936484A

United States Patent [19]

Dolfi et al.

[11] Patent Number: 5,936,484

[45] **Date of Patent: *Aug. 10, 1999**

[54] UHF PHASE SHIFTER AND APPLICATION TO AN ARRAY ANTENNA

[75] Inventors: Daniel Dolfi, Orsay; Jean-Pierre Huignard, Paris; Pascal Joffre, Palaiseau; Michèle Labeyrie, Fontenay Aux Roses; Jean-Claude Lehureau, Ste Genevieve des Bois, all of France

[73] Assignee: Thomson-CSF, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/722,226

[22] PCT Filed: Feb. 24, 1995

[86] PCT No.: PCT/FR95/00226

§ 371 Date: Oct. 23, 1996

§ 102(e) Date: Oct. 23, 1996

[87] PCT Pub. No.: WO96/26554

PCT Pub. Date: Aug. 29, 1996

[51] Int. Cl.[6] ..... H01P 1/18

[52] U.S. Cl. ..... 333/156; 333/157; 333/161; 343/754

[58] Field of Search ..... 333/138, 140, 333/156–158, 161, 164; 342/371–375; 343/700 MS, 754

[56] References Cited

U.S. PATENT DOCUMENTS

| | | | |
|---|---|---|---|
| 3,631,501 | 12/1971 | Buscher | 333/157 |
| 4,072,956 | 2/1978 | Provencher | 343/844 |
| 4,460,897 | 7/1984 | Gans | 333/238 X |
| 4,864,312 | 9/1989 | Huignard et al. | 342/375 |
| 5,032,805 | 7/1991 | Elmer et al. | 333/156 |
| 5,194,972 | 3/1993 | Lim et al. | 333/157 X |
| 5,298,740 | 3/1994 | Ayral et al. | 250/227.11 |
| 5,307,033 | 4/1994 | Koscica et al. | 333/161 |
| 5,307,306 | 4/1994 | Tournois et al. | 364/822 |
| 5,309,166 | 5/1994 | Collier et al. | 333/157 X |
| 5,334,958 | 8/1994 | Babbitt et al. | 333/156 |
| 5,416,490 | 5/1995 | Popovic | 343/700 MS |
| 5,428,697 | 6/1995 | Dolfi et al. | 385/24 |
| 5,430,454 | 7/1995 | Refregier et al. | 342/375 |
| 5,451,567 | 9/1995 | Das | 333/99 S |
| 5,475,525 | 12/1995 | Tournois et al. | 359/245 |
| 5,504,466 | 4/1996 | Chan-Son-Lint et al. | 333/159 |
| 5,561,407 | 10/1996 | Koscica et al. | 333/161 |

FOREIGN PATENT DOCUMENTS

| | | | |
|---|---|---|---|
| 0056205 | 7/1982 | European Pat. Off. . | |
| 2709209 | 2/1995 | France . | |
| 0214105 | 10/1985 | Japan | 333/156 |

OTHER PUBLICATIONS

Dolfi et al., "Liquid Crystal Microwave Phase Shifter", Electronics Letters, vol. 29, No. 10, pp. 926–928, May 13, 1993.

Tang et al. "Array Technology", Proceedings of the IEEE, vol. 80, No. 1, pp. 173–182, Jan. 1992.

*Primary Examiner*—Seungsook Ham

*Attorney, Agent, or Firm*—Oblon, Spivak, McClelland, Maier & Neustadt, P.C.

[57] ABSTRACT

A UHF phase shifter including a UHF waveguide having an electrooptical element lying between two elements 3 and 4 made of materials which have permittivity higher than that of the electrooptical element. An electric polarization field is applied for controlling the electrooptical element and a UHF line is inserted into the element. The control of the orientation of the molecules of the electrooptical element allows for a variation of the index of the element as seen by the field of a UHF wave.

15 Claims, 5 Drawing Sheets

F

UHF PHASE SHIFTER AND APPLICATION TO AN ARRAY ANTENNA

BACKGROUND OF THE INVENTION

1. Field of the Invention

The invention relates to a UHF phase shifter and its application to an array antenna. The invention relates more particularly to a liquid-crystal phase shifter for UHF signals.

Such a phase shifter is suitable for controlling signals the frequency of which may typically stretch from 1 to 100 GHz. It essentially includes a UHF waveguide filled with an electrooptical material the permittivity of which is controlled particularly by electrical means.

2. Discussion of Background

The majority of electronic scanning antennae, except for antennae with active modules, use ferrite-type or diode-type phase shifters (such as the antennae of "RADANT" type) controlled magnetically. By virtue particularly of their low insertion losses, ferrite-type shifters have the advantage of withstanding high powers. However, they exhibit the drawbacks of being heavy, bulky and relatively sensitive to variations in temperature.

PIN-diode type phase shifters are used mainly in active antennae. They exhibit the advantages of being light, compact and fairly insensitive to temperature variations as well as the drawbacks of higher insertion losses and thus less good resistance to high powers.

Diode-type phase shifters are essentially of two types.

switching type. They cause the signal to flow over different path lengths and are suitable for high phase shifts ($\pi/2$ or $\pi$).

perturbation type. They bring variable impedances onto the transmission line and are rather intended for low phase shifts ($\pi/8$ or $\pi/4$).

SUMMARY OF THE INVENTION

The device described according to the invention uses the electrooptical properties of the material such as a liquid crystal filling a planar guide of the "microstrip" type.

The invention therefore relates to a UHF phase shiftel characterized in that it comprises a UHF waveguide including an element made of electrooptical material lying between two elements made of materials with permittivities higher than those of the element made of electrooptical material, means of applying a polarization electric field making it possible to control the electrooptical material.

More particularly, the invention relates to a UHF phase shifter, characterized in that it comprises:

at least one layer of liquid crystal enclosed between a first and a second plate with permittivities higher than those of the liquid crystal, a first plate including a UHF line conductor capable of transmitting a UHF signal, as well as means of applying a polarization electric field to the liquid crystal.

According to one preferred embodiment, the means of applying the electric polarization field include electrodes situated on either side of the liquid crystal; one of the electrodes is the UHF line and the other electrode is situated on the second plate.

BRIEF DESCRIPTION OF THE DRAWINGS

The various objects and characteristics of the invention will emerge more clearly in the description which follows and which describes a non-limiting embodiment of the invention, as well as in the attached figures which represent.

DESCRIPTION OF THE PREFERRED EMBODIMENTS

Figure 1:
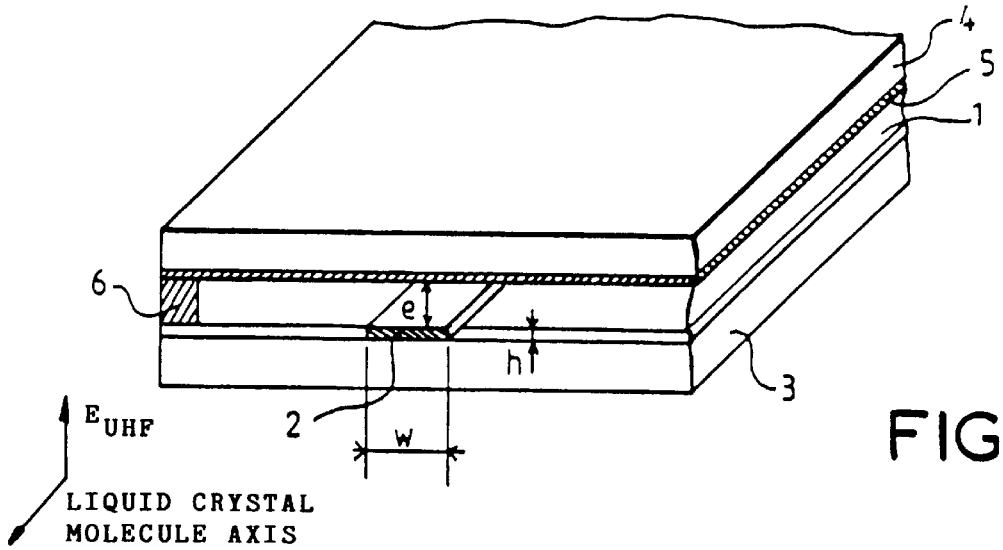
FIG. 1, a basic embodiment of the phase shifter according to the invention.

Referring to FIG. 1, a basic embodiment of the phase shifter according to the invention will now be described.

A UHF line 2 (or microstrip) is deposited on a substrate plate 3 made of insulating material having high permittivity $\epsilon$. The plate 3 is, for example, made of alumina. In addition, a layer of polyimide of thickness h covers the substrate as well as, very lightly, the UHF line 2. This polyimide layer exhibits the characteristics of a layer for bonding and orienting the molecules of a liquid crystal which will be mentioned below.

A second substrate 4, for example, also of alumina, is metallized over the whole of its surface then also covered by a layer for bonding the liquid crystal, of polyimide type.

Spacers 6 (mylar film, polyimide studs, etc.,) are arranged between the two substrates 3 and 4 which are then sealed. The cell thus constructed is filled with liquid crystal 1. The molecules of the liquid crystal are oriented by the polyimide layers in such a way that the molecules are parallel to the walls, their optical axis being, for example, orthogonal to the direction of propagation of a UHF wave in the UHF line 2. The UHF line is matched to 50Ω so as to minimize the reflections at its ends.

The dimensions of the substrate plates 3 and 4 are chosen to allow the necessary contacts to be made.

Figure 2:
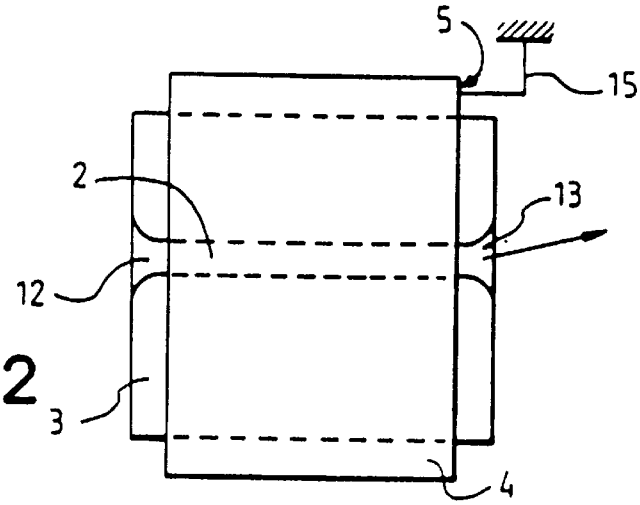
FIG. 2, an example of the phase shifter of FIG. 1, seen from above.

Thus on FIG. 2, it is seen that the substrate 3 allows for contacts 12, 13 to be made onto the UHF line 2 as well as 15 onto the electrode 5 on the substrate 4, the latter being, for example, taken to zero potential.

When the line is excited by a low-amplitude UHF signal, the electric field $E_{UHF}$ propagating in the structure is essentially vertically polarized (FIG. 1). This field $E_{UHF}$ is, moreover, principally confined in the liquid crystal layer because of the higher value of the relative permittivity of the alumina (greater than that of the liquid crystal). Hence, the electric field $E_{UHF}$ is orthogonal to the optical axis of the molecules of the liquid crystal 1. The index seen by the field $E_{UHF}$ is then $n_o$.

In contrast, when, the field $E_{UHF}$ in the line has superimposed on it a low-frequency or DC electric field $E_o$, of sufficient amplitude to straighten out the liquid crystal molecules, the optical axis of the molecules becomes parallel to $E_{UHF}$ and the index seen by the field is then $n_e$.

The amplitude of the field $E_{UHF}$ must be below $E_{threshold}$, the electric field for which the liquid crystal molecules straighten out.

If the line length immersed in the liquid crystal is 1, the time $\tau(V_o)$ taken by the wave associated with $E_{UHF}$ to pass through the structure is equal to:

$$\tau(V_o)=1.n(V_o)/c$$

where c: speed of light in a vacuum $V_o$: quasi-static potential applied to the line corresponds to the field $E_o$ $n(V_o)$ : effective index seen by the field $E_{UHF}$.

If $V_o<V_{threshold}$: $n=n_o$ $V_oV_{sat}$: $n=n_e$ $V_{threshold}<V<Vsat$: $n=n(V_o)$ If the electric field of the inlet to the UHF line 2 is of the form: $E_{incident}=E_1 \cos 2\pi ft$, the electric field $E_{UHF}$ at the exit from the line is therefore of the form:

$$E_{UHF}=E_1 \cos 2\pi f(t-\tau(V_o))\ E_1 \cos [2\pi ft-2\pi.f.l.n(f,V_o)/c]$$

where f is the frequency of the field (f~a few GHz).

The effective index $n(f, V_o)$ takes account both of the voltage dependency but also of the frequency dispersion of the liquid crystal and of the guide.

Measurements taken have made it possible to reveal, between 2 and 18 GHz a birefringence $\Delta n=|n_e-n_o|\sim 0.1$. In what follows, an example is given of an embodiment of a phase shifter operating at f=10 GHz.

The thickness e of the liquid crystal is 20 to 100 $\mu$m, for which thickness the alignment is still homogenous.

The dimensions w and h of the line are chosen in such a way that its resistance is negligible and that it exhibits a characteristic impedance close to 50Ω. It has been shown that, for a UHF line to exhibit a characteristic impedance of Z=50Ω, when the permittivity of the liquid crystal medium is $\epsilon_r$, it is necessary for the w/e ratio to be equal to:

$$\varepsilon_r = 2 \quad w/e = 3.4$$

$$\varepsilon_r = 5 \quad w/e = 1.7$$

$$\varepsilon_r = 10 \quad w/e = 1.0$$

$$\varepsilon_r = 15 \quad w/e = 0.6$$

(see document "Microstrip lines and Slotlines" K. C. Gupta, T. Garg, I. J. Bahl - Artech House, 1979).

The values of $\epsilon_r$ supplied are typical values for the liquid crystal materials.

Moreover, the thickness h of the conductor must satisfy: $\rho 1/w.h<<50\Omega$ where ρ is the resistivity of the metal constituting the UHF line. In the case, for example, of a copper deposition, where ($\rho\sim 1.7\times 10^{-8}\Omega$m) then h>>1 $\mu$m(for 1~10 cm)

Hence a thickness h=10 $\mu$m, easily achievable by electrolytic forming satisfies these conditions.

The line length l necessary to allow control of the phase between 0 and 2π is given by:

$$l = c/\Delta n \cdot f$$

Figure 3:
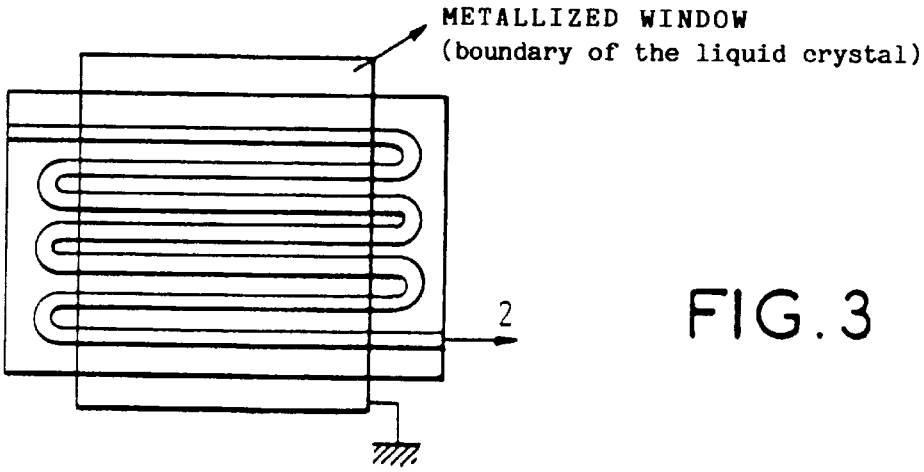
FIG. 3, another embodiment of the invention seen from above.

For $\Delta n = 0.1$, then:

-continued $f = 10$ GHz  $l = 30$ cm $f = 30$ GHz  $l = 10$ cm $f = 100$ GHz  $l = 3$ cm For f=10 GHz, for example, the UHF line length is not necessarily formed in a straight line but can be folded several times as is represented in FIG. 3. It is sufficient to that end that the curve regions, where the orientation of the electric field $E_{UHF}$ with respect to the liquid crystal molecules is badly defined, are shifted outside the region filled by the liquid crystal.

Moreover, independently of the transmission losses related to the liquid crystal, the UHF line exhibits metallic losses due to the geometry (low dielectric thickness) which it has been possible to estimate at substantially 10 dB/m at 10 GHz. This level is compatible with the application envisaged.

According to experiments carried out, such a device functions with a voltage $V_o$ for control of the orientation of the liquid crystal which does not exceed about 10 volts due to the slight thickness of liquid crystal. The switching times in this configuration may be of the order of a millisecond.

Figure 4:
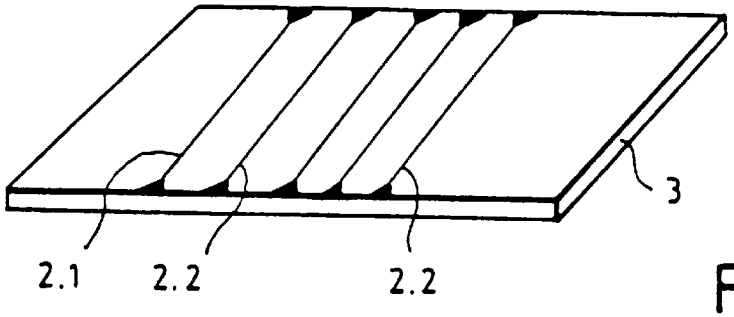
FIG. 4, an embodiment with several phase shifters of the device of the invention.

FIG. 4 represents an embodiment of the invention including several UHF lines 2.1, 2.2, . . . 2.0n. In FIG. 4 only the plate 3 carrying the UHF lines has been represented. The plate 4 and the liquid crystal 1 have not been represented and are similar to those of FIG. 1.

The n UHF lines 2.1 to 2.0n constitute n independently controllable phase shifters.

They are each fed with a UHF signal. In order to control them differently, it is sufficient to apply a specific control voltage $V_o$ independently to each UHF line.

Such a phase shifter with several UHF lines can be envisaged on a substrate plate of 10×10 cm. Having regard to the lateral extension of the modes of guides which can be twice the width of the UHF lines, for example 2w=200 $\mu$m it is easily possible to provide for more than 100 phase shifters on the same substrate 3.

Figure 5:
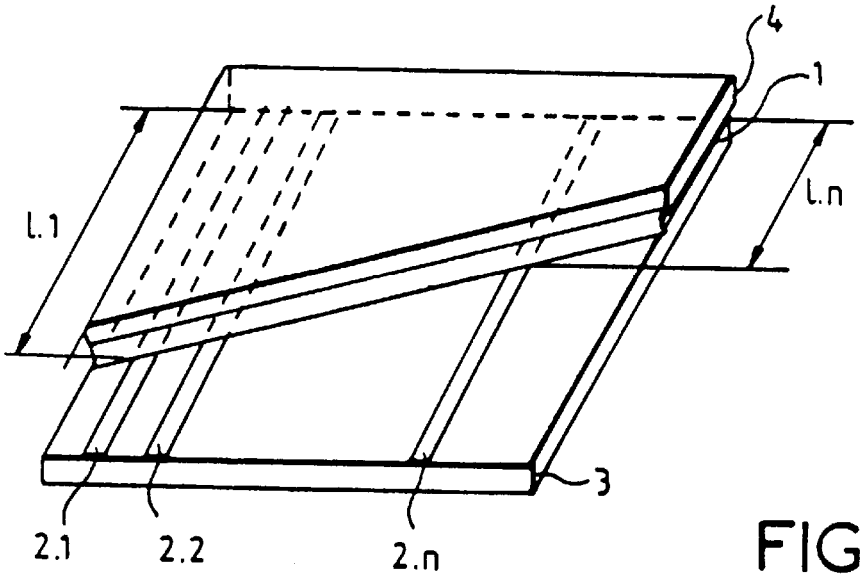
FIG. 5, an embodiment of the device of the invention with UHF lines of different lengths.

A variant embodiment of the device of FIG. 4 is represented in FIG. 5. According to this variant, the UHF lines are of different lengths. More precisely, the lengths of the lines coupled to the liquid crystal are different. For example, according to FIG. 5, it is possible to have line lengths l.1 to l.n which reduce progressively from the line 2.1 to the line 2.0n. Under these conditions, in order to have different phase shifts with the different lines, it is possible to apply the same electric field to the whole of the liquid crystal. This can be done by applying the same voltage between each UHF line and the electrode 5 situated on the other side of the liquid crystal.

Figure 6:
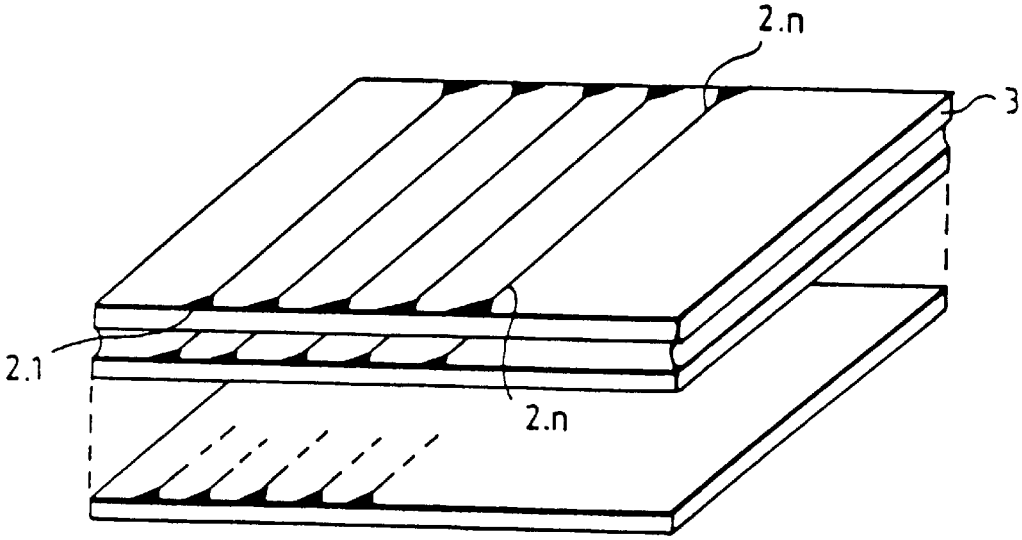
FIGS. 6 and 7, examples of a stack of phase shifters according to the invention.

FIG. 6 represents an embodiment in which several devices such as that of FIG. 4 are stacked. This device is controlled by applying to the different lines potentials which may be different in order to obtain different phase shifts. To do that, it is possible to apply identical potentials to all the lines of one plate and to have different potentials from one plate to another. It is also possible to have different potentials on the same plate and also different from one plate to the other.

According to a variant which is not represented, the invention provides for several devices such as that of FIG. 5 to be stacked. The lines of each plate can be controlled jointly by the same potential, each potential being different from one plate to another.

Figure 7:
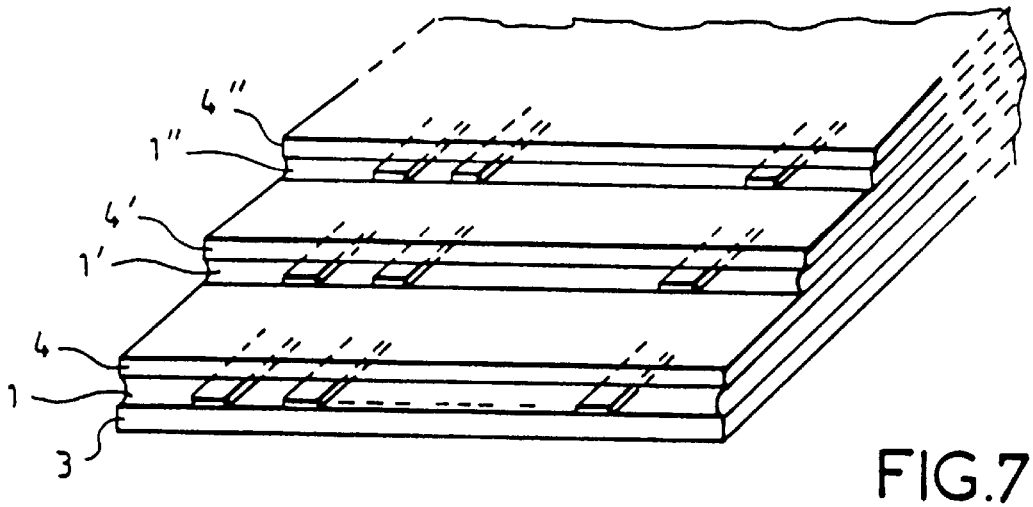

Finally, according to another variant represented in FIG. 7, it is possible to stack several devices each having UHF lines of the same length but the lengths being different from one plate to another.

Figure 8A:
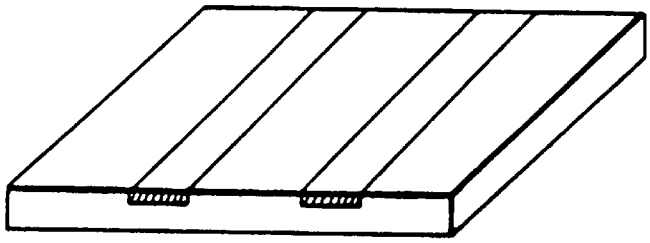
FIGS. 8*a*, 8*b*, a variant embodiment of the phase-shifter device according to the invention.
Figure 8B:
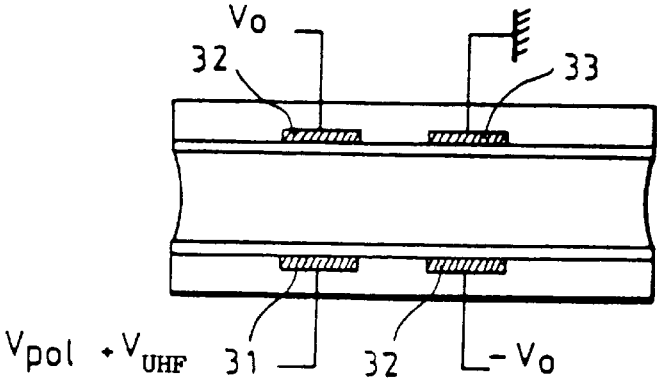

FIGS. 8*a* and 8*b* represent a structure of the "slotline" type, in which the lines 31 and 32 are sufficiently close together for the field $E_{UHF}$ to be polarized parallel to the substrate. Depending on the DC voltage supplied to the four electrodes 31, 32, 33, 34, and field $E_o$ is available orienting the molecules which can take all orientations in the plane orthogonal to the direction of propagation of the field $E_{UHF}$ along the line 31. This makes it possible to force the molecules to align onto the DC field and thus to benefit from response times which are no longer limited by the mechanical relaxation of the liquid crystal then the polarization field applied is removed.

Such a phase shifter according to the invention exhibits the following advantages:

the structure according to the invention is planar;

it is possible to achieve electrical control at low level and to obtain analogue control of the phase shifts;

the device obtained is inexpensive by virtue of the use of technologies developed widely in visual display techniques;

the size is small by reason of the high value of Δn.

Figure 9A:
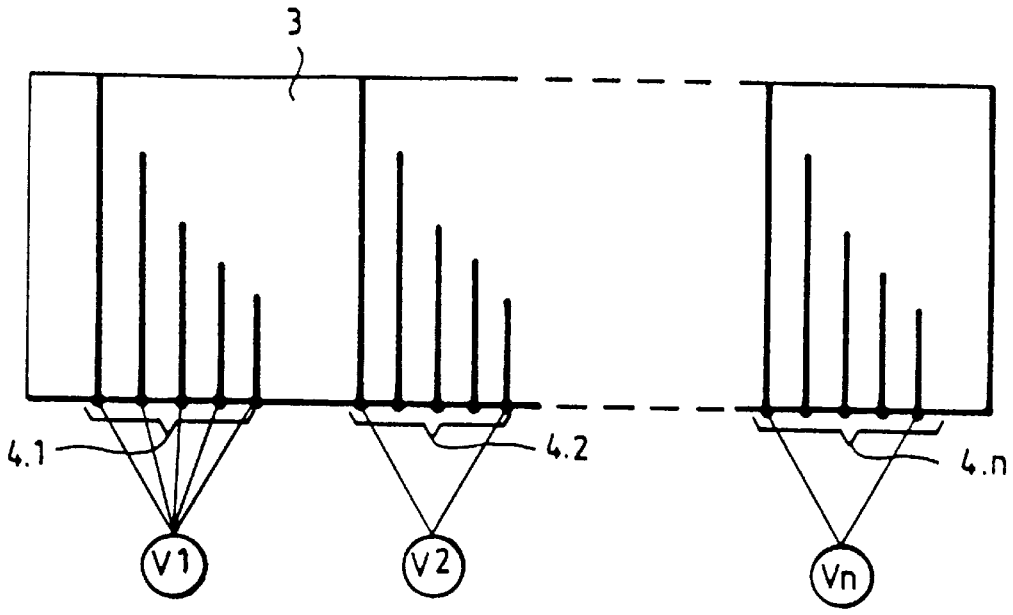
FIGS. 9*a* and 9*b*, further variant embodiments of the phase-shifter device according to the invention.

According to another variant embodiment represented in FIG. 9*a*, different configurations, such as those represented in FIG. 5, can be produced on the same plate 3. Hence there are several sets 4.1, 4.2, . . . 4.0n of UHF lines on the same plate 3. The various sets are controlled by polarization voltages $V_1$, $V_2$, . . . $V_n$ of different values.

Figure 9B:
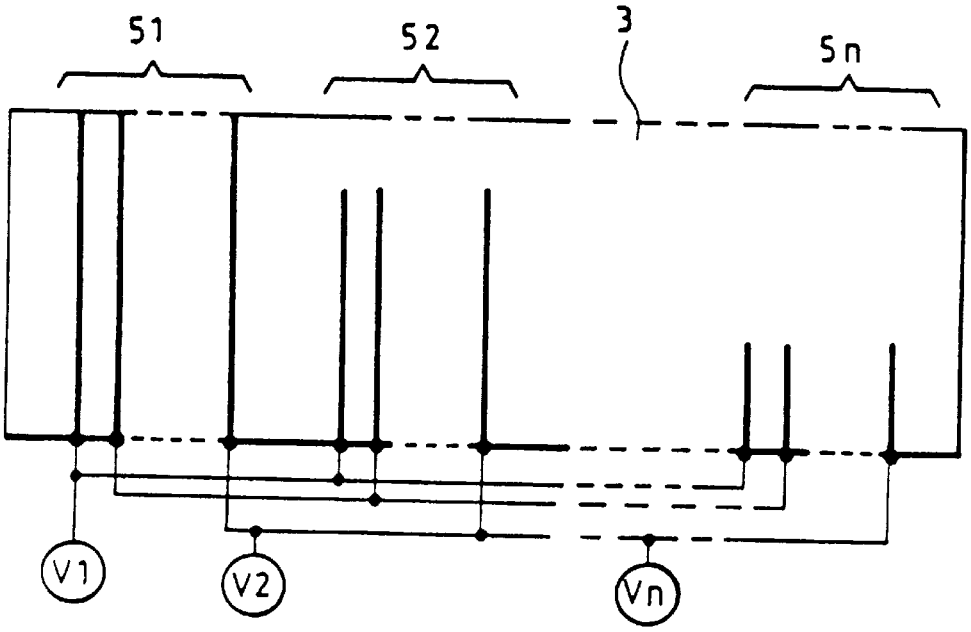

In FIG. 9*b*, several sets of UHF lines 51, 52, . . . 5.0n of different lengths have been produced. In each set, the UHF lines have the same length. Voltage control is by generators $V_1$ to $V_N$ equal in number to the number of lines in each set. The generator $V_1$ controls the first line of each set. The generator $V_N$ controls the last line of each set.

Figure 10:
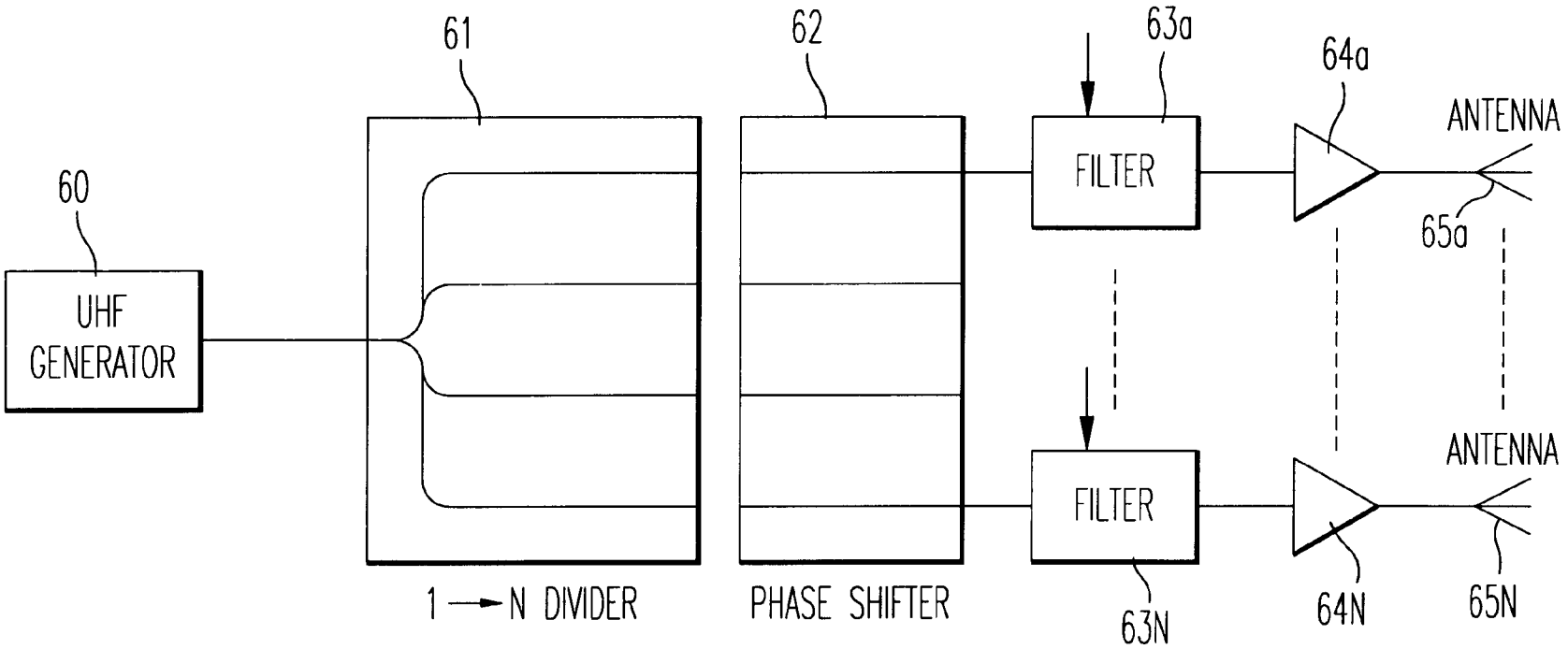
FIG. 10, an example of the application of the invention to antenna control.

FIG. 10 represents an example of the application of the phase shifter according to the invention to control of an electronic scanning antenna.

This system includes a UHF generator 60 sending out a UHF signal. A distributor (or splitter) 61 receives this UHF signal on one input and distributes it over several outputs. The phase-shifter device 62, as previously described, is connected to these outputs, one UHF line of the phase-shifter device being connected to each output of the distributor. Each UHF line has its outlet connected to a filter $\mathbf{63}_a$–$\mathbf{63}_N$ which eliminates the control voltage ($V_{pol}$) of the phase-shifter device. An amplifier $\mathbf{64}_a$ –$\mathbf{64}_N$ amplifies the UHF signal for each UHF line and transmits it to a respective radiating element of the antenna $\mathbf{65}_a$–$\mathbf{65}_N$.

We claim:

1. A UHF phase shifter including a UHF waveguide comprising:

an element of liquid crystal material, which is not a ferroelectric material, enclosed between a first plate and a second plate wherein a permittivity of each of said first plate and second plate is higher than a permittivity of said liquid crystal material and wherein said first plate includes a plurality of electrodes situated on one side of the liquid crystal material to form a UHF line conductor and wherein each electrode allows for an application of a different electric field from one electrode to another, said second plate including an electrically conductive material that directly contacts said liquid crystal material; and means for applying to each electrode respective different electric fields, said means for applying including another electrode positioned on a side of said liquid crystal material that is opposite of said one side.

2. Phase shifter according to claim 1, characterized in that faces of the plates in contact with the liquid crystal are treated in such a way that, in the absence of an electric field being applied to the liquid crystal, molecules thereof have their optical axis aligned along a direction parallel to the plane of the plates.

3. Phase shifter according to claim 1, characterized in that faces of the plates in contact with the liquid crystal are treated in such a way that, in the absence of an electric field being applied to the liquid crystal, molecules thereof have their optical axis aligned along a direction parallel to the plane of the UHF line conductor.

4. Phase shifter according to claim 3, characterized in that a field of a UHF signal ($E_{UHF}$) is oriented perpendicularly to a plane of the plates.

5. Phase shifter according to claim 3, further comprising a third electrode parallel and to coplanar UHF line conductor for orientating a field of a UHF signal ($E_{UHF}$) parallel to the plane of the plates.

6. Phase shifter according to claim 1, characterized in that said plurality of electrodes are parallel to each other.

7. Phase shifter according claim 1, characterized in that the lengths of said plurality of electrodes coupled to the liquid crystal material are different from one electrode to another.

8. Phase shifter according to claim 1, comprising additional elements of liquid crystal material including additional electrodes, said additional elements being stacked on said element of liquid crystal material.

9. Phase shifter according to claim 1, further comprising several groups of said plurality of electrodes of the same length and of different lengths from one group to another.

10. Phase shifter according to claim 1, further comprising identical groups of said electrodes of different lengths.

11. Phase shifter according to claims 9, further comprising the same number of polarization voltage sources as there are electrodes of the same length, each polarization voltage source being connected to the electrodes of different lengths.

12. Phase shifter according to claim 7, further comprising a stack of additional elements of liquid crystal material stacked on said element of liquid crystal material.

13. The phase shifter according to claim 1, wherein said liquid crystal material is at least one layer of liquid crystal.

14. An antenna array comprising:

a first UHF phase shifter including a UHF waveguide having, an element of liquid crystal material, which is not a ferroelectric material, enclosed between a first plate and a second plate wherein a permittivity of each of said first plate and second plate is higher than a permittivity of said liquid crystal material and wherein said first plate includes a plurality of electrodes situated on one side of the liquid crystal to form a UHF line conductor and wherein each electrode allows for an application of a different electric field from one electrode to another, and means for applying to each electrode respective different electric fields, said means for applying including another electrode formed on said second plate, said second plate being in direct contact with said liquid crystal material;

a second UHF phase shifter having a same structure as said first UHF phase shifter;

a UHF generator configured to supply respective UHF signals at respective inlets to each of the plurality of electrodes of the first UHF phase shifter and of the second UHF phase shifter;

amplifiers having one input each connected to respective outlets from respective UHF conductors of the first UHF phase shifter and of the second UHF phase shifter; and antenna radiating elements each connected to respective outputs of the amplifiers.

15. The antenna array of claim 14, further comprising filters respectively situated between the amplifiers and the first UHF phase shifter and the second UHF phase shifter and configured to filter voltages so as to polarize an operation of the first UHF phase shifter and the second UHF phase shifter.

* * * * *